US006216907B1

(12) United States Patent
Morneau

(10) Patent No.: US 6,216,907 B1
(45) Date of Patent: Apr. 17, 2001

(54) DRUM LINER SYSTEM

(76) Inventor: Joseph Gilles Morneau, 150 Vieux Chemin, St-Louis-du-Ha!Ha! Québec (CA), G0L 3S0

( * ) Notice: Subject to any disclaimer, the term of this patent is extended or adjusted under 35 U.S.C. 154(b) by 0 days.

(21) Appl. No.: 09/459,529

(22) Filed: Dec. 13, 1999

(51) Int. Cl.[7] ..... B65D 25/16
(52) U.S. Cl. ..... 220/495.05; 220/4.04
(58) Field of Search ..... 220/495.03, 495.05, 220/495.06, 495.08, 1.6, 4.04, 4.05

(56) References Cited

U.S. PATENT DOCUMENTS

| | | | | |
|---|---|---|---|---|
| 2,564,163 | * | 8/1951 | Leperre | 220/495.03 X |
| 2,987,216 | * | 6/1961 | Fletcher | 220/495.05 X |
| 3,187,934 | * | 6/1965 | Huber | 220/495.06 |
| 3,918,605 | | 11/1975 | Butler | 220/63 R |
| 4,094,432 | | 6/1978 | Zilbert | 220/404 |
| 4,114,779 | | 9/1978 | Stoll, III | 220/288 |
| 4,635,814 | * | 1/1987 | Jones | 220/495.05 |
| 5,005,726 | * | 4/1991 | Robbins | 220/495.05 X |
| 5,046,634 | | 9/1991 | McFarlin et al. | 220/465 |
| 5,154,307 | | 10/1992 | Hauk | 220/403 |
| 5,154,308 | | 10/1992 | Larson | 220/403 |
| 5,169,019 | | 12/1992 | Büdenbender | 220/404 |
| 5,217,138 | | 6/1993 | Nichols | 220/403 |
| 5,222,620 | | 6/1993 | Lima et al. | 220/404 |
| 5,379,913 | | 1/1995 | Rieke et al. | 220/601 |

FOREIGN PATENT DOCUMENTS

| | | |
|---|---|---|
| 15127 | 10/1992 | (AU) . |
| 2061161 | 8/1992 | (CA) . |
| 2228725 | 9/1990 | (GB) . |

* cited by examiner

*Primary Examiner*—Steven Pollard
(74) *Attorney, Agent, or Firm*—Mario Theriault

(57) ABSTRACT

A common metal drum is used in an upside down orientation and has a drum liner system installed through the designated bottom surface thereof. The drum liner system comprises an adapter mounted through the designated bottom surface. The adapter has a relatively large opening through which the liner is easily installed and the drum can be easily inspected and repaired. In another aspect, the adapter and a liner collar share a common thread, and a cover is mountable over this common thread. The thread portion on the liner collar is selectively movable relative to the thread portion on the adapter to cause a locknut effect therebetween and to retain the cover on the adapter and the liner collar. In a further aspect, a drum liner is bonded to the liner collar and is folded inside the liner collar. A hermetic wrapper is stretched around the liner collar and the drum liner. This drum liner package is particularly advantageous for being shippable to a user in an aseptic condition and for being maintainable in this condition prior to use.

20 Claims, 7 Drawing Sheets

DRUM LINER SYSTEM

FIELD OF THE INVENTION

The present invention relates to drum liners and more specifically the present invention relates to drum liners that are mountable is common metal drums and that are washable and shippable to users in an aseptic condition and reusable.

BACKGROUND OF THE INVENTION

Drum liners are used primarily to prevent product contamination in metal drums and other barrels containing products that are sensitive to deterioration. Drum liners are also installed in re-used metal drums to extend the useful life of the drum. Although several designs of drum liners exist in the art, it is believed that some specific requirements of the industry have not been properly addressed in the past by prior designs.

One specific example of a very demanding industry with regard to container-related product contamination is the transportation of maple syrup. Maple syrups are recognized by their respective flavour which is relatable by the experts, to the location of a maple grove and to the setting and maple species within that maple grove. Maple syrups are very sensitive to taste deterioration, and the simple contact of the product with an improperly painted metal surface for example, or with the lightly corroded metal of a container can deteriorate its flavour beyond usability. Plastic liners have been used in the past inside metal drums and common plastic barrels for storing and transporting maple products. However, there remain some concerns with these liners. For example, the syrup is known to adhere to the interior of the liner, and because of the structural arrangement of these liners, recovery can hardly be made. When a purchased batch of syrup is contained in several barrels, the lost of syrup remaining in the empty liners can be substantial.

Another concern with liners of the prior art is that generally, metal drums have bung holes of relatively small size through which some liners are installed. The relatively small sizes of theses bung holes represent certain limitations in the installation of a liner. These limitations are known to compromise the cleanliness and impermeability of a new liner during its installation inside a barrel.

Examples of prior art plastic liners for use in metal drums and plastic barrels are illustrated in the following patent applications and issued U.S. patents.

AU-B-15,127 filed by R. M. Matyja, and published Oct. 29, 1992;

CA 2,061,161 filed by W. Lima et al., and published on Aug. 15, 1992;

GB 2,228,725 filed by G. K. Bunschoten, and published on Sep. 5, 1990;

U.S. Pat. No. 3,918,605 issued on Nov. 11, 1975 to C. J. Butler;

U.S. Pat. No. 4,094,432 issued on Jun. 13, 1978 to S. Zilbert;

U.S. Pat. No. 5,046,634 issued on Sep. 10, 1991 to G. P. McFarlin et al.;

U.S. Pat. No. 5,154,307 issued on Oct. 13, 1992 to T. W. Hauk;

U.S. Pat. No. 5,154,308 issued on Oct. 13, 1992 to D. A. Larson;

U.S. Pat. No. 5,169,019 issued on Dec. 8, 1992 to B. B üdenbender;

U.S. Pat. No. 5,217,138 issued on Jun. 8, 1993 to D. E. Nichols;

U.S. Pat. No. 5,222,620 issued on Jun. 29, 1993 to W. Lima et al.;

U.S. Pat. No. 5,379,913 issued on Jan. 10, 1995 to T. M. Rieke et al.;

Because of the aforesaid concerns, basically, it is believed that there continues to be a need in the industry for a drum liner system which is mountable in a common metal drum, which allows for a sanitary installation of the liner therein and from which adhered product can be easily washed out and recovered.

SUMMARY OF THE INVENTION

The present invention provides for a drum liner system which has a large opening, a holed flange associated therewith for easy installation in a steel drum's end surface, and through which the drum can be easily cleaned and reconditioned. The liner is shippable to a user in an aseptic package. After use, the liner can be pulled inside-out through the large opening for washing adhered product therefrom. When the adhered product is maple syrup, the rinse water is evaporated to recover the syrup.

Broadly, in accordance with a first aspect of the present invention there is provided a common metal drum having a drum liner system mounted therein. The common metal drum has a designated top and bottom surfaces. The drum is used in an upside down position and the drum liner system is installed through the designated bottom surface.

The drum liner system comprises an adapter mounted through an opening in the designated bottom surface of the drum, and having a flange connected to the designated bottom surface. An annular channel is bordering the flange and extends inside the opening. A liner collar is mounted over the adapter and has a sleeve portion extending inside the annular channel. A drum liner is bonded to the sleeve and extends inside the drum. The liner support system also includes a cover which is attachable to the adapter for covering the liner collar and the drum liner.

In this installation, the liner support surface is generally in a better condition than the opposite end of the drum. Because this designated bottom surface is generally free from any fittings, the opening and the adapter can have a relatively large size through which the drum can be easily inspected, repaired and reused several times for storing and transporting sensitive products. Also, the bung hole and vent plug in the designated top surface of the drum are usable as drain holes for assisting in the reconditioning of the drum.

In accordance with another aspect of the present invention, there is provided a drum liner system for installation in a metal drum or plastic barrel. This drum liner system comprises an adapter which is mountable in an opening in an end of a drum. The adapter has an annular flange and an annular channel bordering the annular flange and extending through a plane defined by the annular flange. The annular channel has a first external thread on a surface thereof. The drum liner system also comprises a liner collar mounted over the adapter and having a sleeve extending inside the annular channel. The liner collar has a second external thread on a surface thereof, and the second external thread is similar to and continuous with the first external thread on the adapter. The liner support system also comprises a drum liner bonded to the sleeve and a cover covering the liner collar and the liner. The cover has an internal thread on one of its surfaces and this internal thread has a similar shape and pitch as the first and second external threads, and is engaged over the first and second external threads.

The liner collar and the adapter are selectively positional relative to each other to wedge the first and second external threads against each other inside the internal thread to secure the cover on the adapter and on the liner collar. This locking action of the first and second external threads is advantageous for preventing inadvertent loosening of the cover during handling and transport of a drum having the liner support system mounted thereon.

In a further aspect of the present invention, there is provided drum liner package for installation in a drum having an appropriate drum liner adapter mounted thereon. This drum liner package comprises a liner collar having an inside diameter and a depth perpendicular to the inside diameter. A drum liner is bonded to the liner collar, and is folded inside the liner collar. A hermetic wrapper is stretched around the liner collar and the drum liner. This drum liner package is particularly advantageous for being shippable to a user in an aseptic condition, and for being maintainable in this condition prior to use.

Still other features of the invention are that it is susceptible of a low cost of manufacture with regard to materials, equipment and labour, and which accordingly is then susceptible of low price of sale to the industry, thereby making such liner support system economically available to the public.

Other advantages and novel features of the invention will become apparent from the following detailed description.

BRIEF DESCRIPTION OF THE DRAWINGS

A preferred embodiment of the present invention selected by way of example will now be described with reference to the accompanying drawings in which.

DETAILED DESCRIPTION OF THE PREFERRED EMBODIMENT

Figure 1:
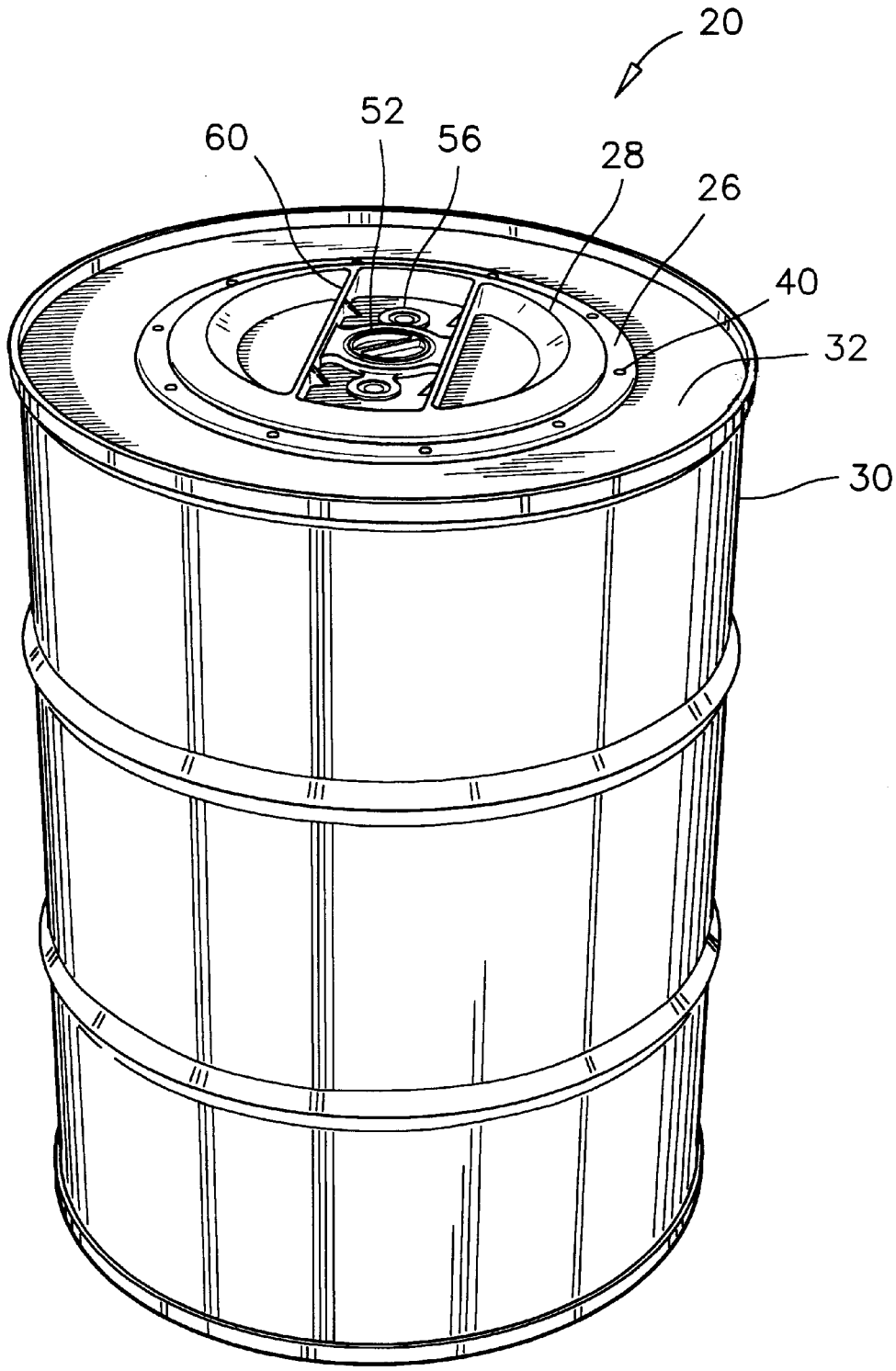
FIG. 1 illustrates a common metal drum having a drum liner system according to the preferred embodiment mounted therein.

While this invention is susceptible of embodiments in many various forms, there is shown in the drawings and will be described in details herein a specific embodiment, with the understanding that the present disclosure is to be considered as an example of the principles of the invention and is not intended to limit the invention to the embodiment illustrated.

Figure 3:
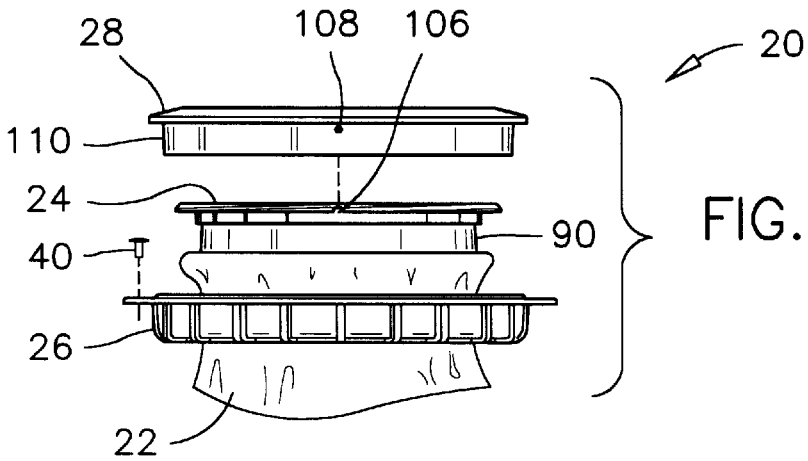
FIG. 3 is a partial exploded side view of the drum liner system according to the preferred embodiment.
Figure 2:
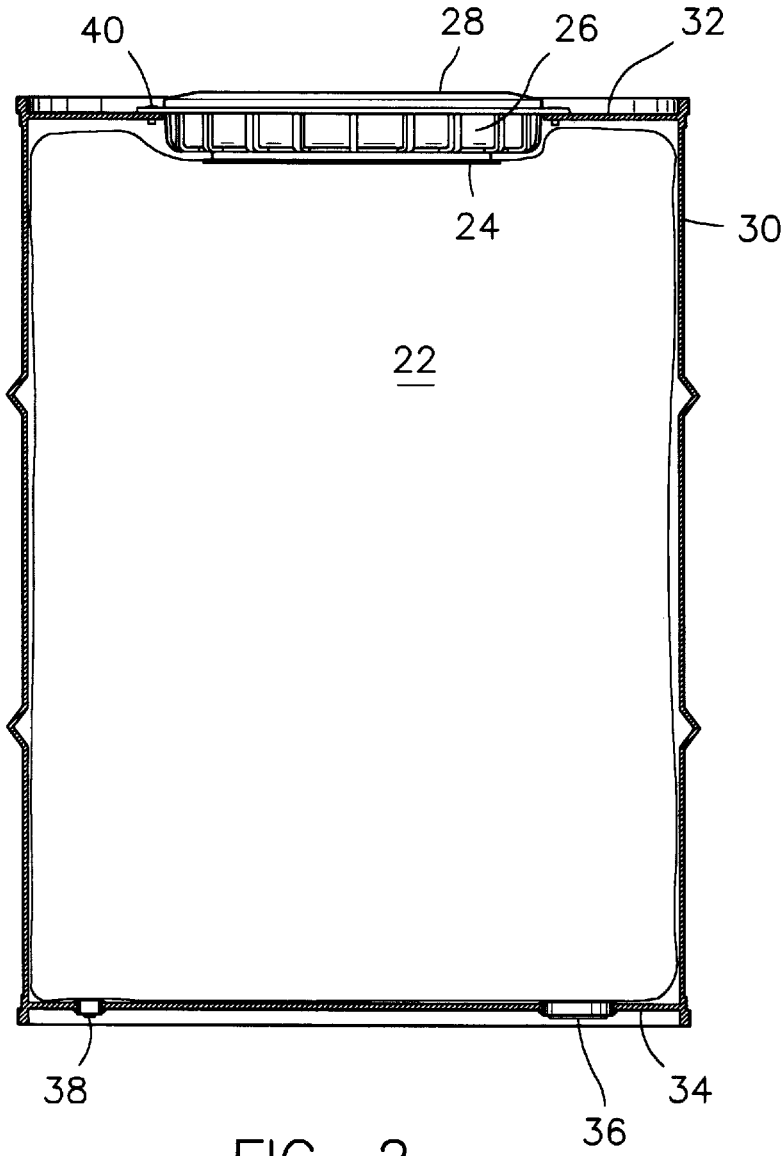
FIG. 2 is a vertical cross-section view through the drum illustrated in FIG. 1.

Referring firstly to FIGS. 1, 2 and 3, the drum liner system 20 according to the preferred embodiment comprises a plastic liner 22 and a liner collar 24 bonded to and circling the opening of the liner 22. The drum liner system also comprises an adapter 26 for supporting the collar 24, and a cover 28 which is mountable over the liner collar 24 and the adapter 26 for retaining the liner collar 24 in to the adapter 26 and for sealing the liner 22. The dimensions of the liner collar 24, the adapter 26 and the cover 28 are selected to provide sliding fit tolerances therebetween except where indicated otherwise, to afford mutual assembly and disassembly by hand. The material of construction of the liner 22, the liner collar 24, the adapter 26 and the cover 28 is preferably a food-approved grade of plastic. The liner 22 preferably has a thickness of about 4–6 mils or more.

The drum liner system 20 is preferably installed on a common metal drum 30 through the bottom surface 32 of the drum. The metal drum is thereafter used in the upside down orientation. A first reason for doing this is that the bottom surface 32 of a metal drum is generally in a better condition than the top surface with regard to corrosion after extended use. The second reason being that the top surface 34 of a metal drum contains a bung hole 36 and a vent plug 38, the spacing of which relative to each other or to the rim of the drum represents a restriction in the diameter and placement of an adapter required for supporting a drum liner.

The bottom surface 32 of the drum allows for the relatively easy installation of a larger adapter 26 and a liner 22 with a larger opening, as opposed to a conventional installation. Another advantage related to the installation of the drum liner system in the bottom surface 32 of a metal drum is that the large opening through the adapter 26 is usable for washing, sand blasting and painting the interior of the drum while using the bung hole 36 and vent plug 38 as drain openings to assist in doing this work.

The modification of a metal drum 30 is effected by cutting an opening in the bottom 32 of the drum with a chisel, shears, nibbling machine or otherwise and by rivetting the adapter 26 to the opening. Rolled and sealed rivets 40 are preferred for retaining the flange of the adapter 26 to the bottom surface 32, but other fasteners can also be used.

It is believed that the useful life of a steel drum for example is about 7–8 years. It is further believed that the installation of a drum liner system therein can extend the life cycle of the drum by another 10 to 12 years. Common steel drums are generally easily available at low cost. Therefore, the modification of a steel drum and the installation therein of a drum liner system according to the preferred embodiment represents substantial savings to a producer as compared to the purchase of new drums, plastic barrels or stainless steel containers.

Figure 4:
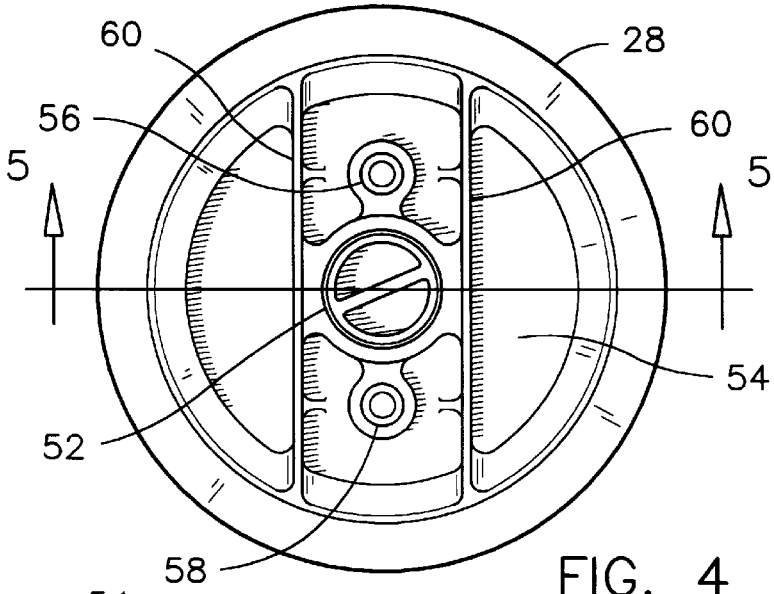
FIG. 4 illustrates a top view of the cover used in the drum liner system according to the preferred embodiment.
Figure 5:
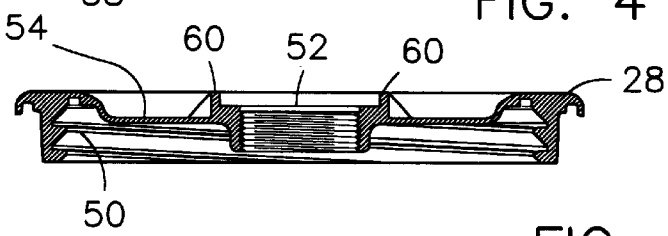
FIG. 5 is a cross-section view of the cover illustrated in FIG. 4, as seen along line 5—5 in FIG. 4.

Referring now to FIGS. 4 and 5, the cover 28 of the liner support system according to the preferred embodiment has a cylindrical configuration which is closed at one end and has an internal thread 50 on the inside surface thereof. The cover 28 also has a bung hole 52 at the center of the closed surface 54. A pair of smaller openings 56, 58 are also provided in the closed surface 54 for the convenience of the user. These smaller openings 56, 58 can be used for examples as vent holes, as sampling holes or to install pressure relief devices (not shown).

A pair of parallel ribs 60 extends across the closed surface 54 on each side of the bung hole 52 and are raised above the closed surface 54. These ribs are advantageous for turning the cover 28 and for engaging the internal thread 50 over the adapter 26 during the assembly of the liner support system 20, as will be explained further hereinafter.

Figure 8:
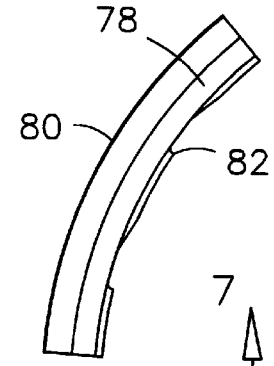
FIG. 8 is an enlarged partial top view of the adapter showing internal notches therein, as seen in detail circle 8 in FIG. 6.
Figure 6:
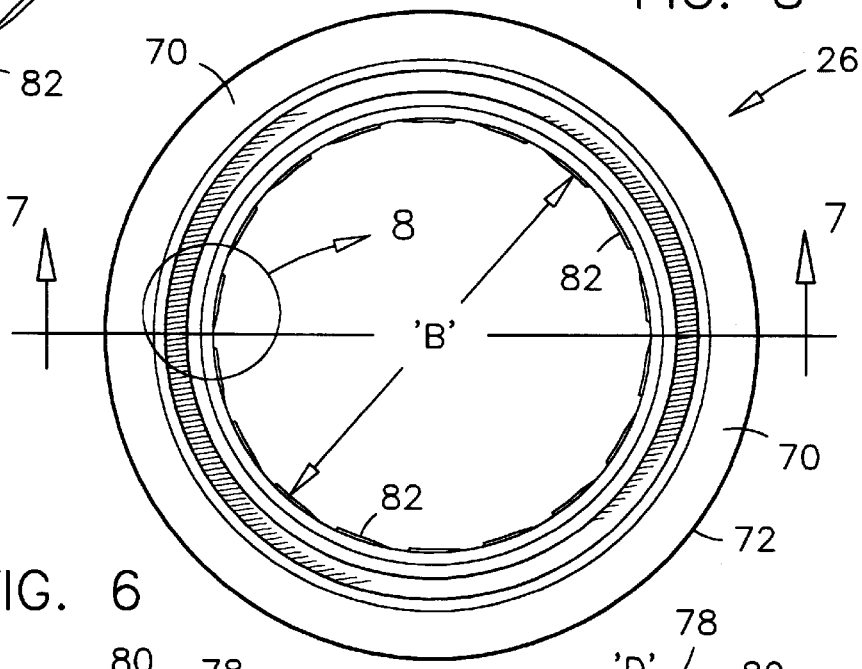
FIG. 6 illustrates a top view of the adapter used in the drum liner system according to the preferred embodiment.
Figure 7:
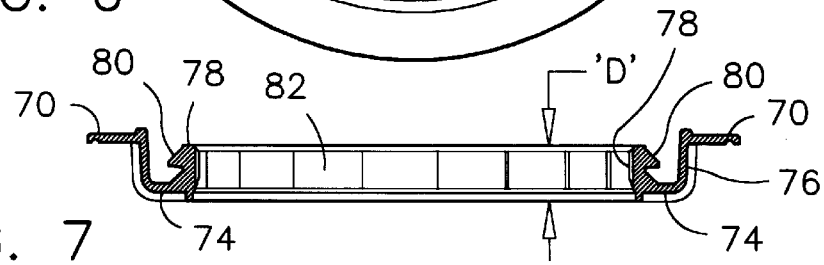
FIG. 7 is a cross-section view of the adapter illustrated in FIG. 6, as seen along line 7—7 in FIG. 6.
Figure 9:
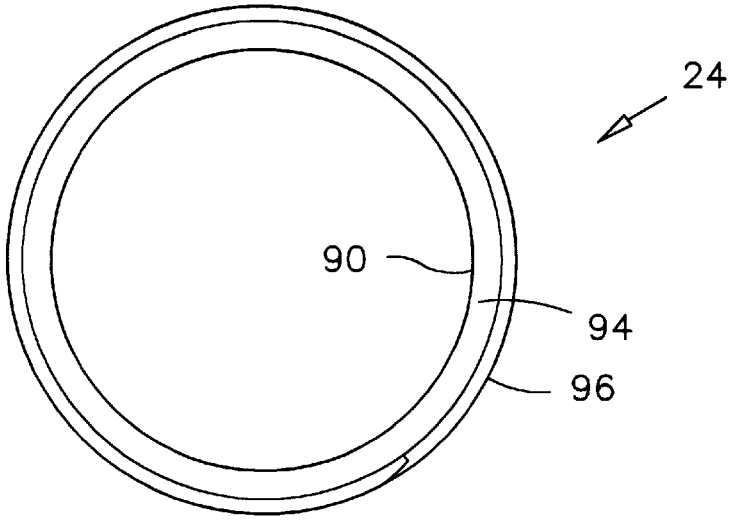
FIG. 9 is a top view of the liner collar used in the drum liner system according to the preferred embodiment.
Figure 10:
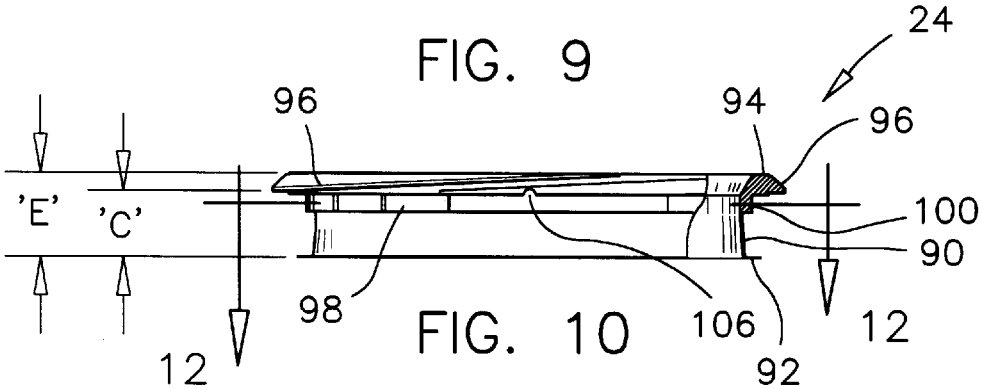
FIG. 10 is a partial side view of the liner collar shown in FIG. 9, illustrated with one segment cut out to show cross-section details.

The adapter 26, as it can be seen in FIGS. 6, 7 and 8, has an annular flange 70 with a plurality of holes 72 therein for bolting or rivetting the flange to the surface of a drum. Bordering the inside edge of the flange 70, there is provided a circular channel 74 connected to the flange 70. The channel 74 has an outside circular wall 76 the section of which makes a right angle with a plane define by the flange 70, and an inside circular wall 78 parallel to and at a distance from the outside circular wall 76. The outside surface of the inside circular wall 78 relative to the central region of the adapter 26 has a first external thread 80 which corresponds in dimensions and pitch to the internal thread 50 in the cover 28. The internal thread 50 is mountable over the first external thread 80 for securing the cover 28 to the adapter 26.

The inside surface of the inside wall 78 relative to the central region of the adapter 26 has a series of equally spaced internal notches 82 formed therein. The function of these notches 82 will be explained later when describing the assembly of the liner collar 24 in to the adapter 26.

Referring now to FIGS. 9–12, the liner collar 24 will be described in details. The liner collar 24 has a sleeve-like portion 90 with a lower circular lip 92 and an upper annular shoulder 94. In use, the annular lip 92 is bonded to the opening of the plastic liner 22 for supporting the liner 22 thereto.

The outside surface of the annular shoulder 94 is shaped to form a second external thread 96. This second external thread 96 has dimensions and a pitch similar to the first external thread 80. The second external thread 96 is continuous with the first external thread 80 when the liner collar 24 is mounted over the adapter 26. The internal thread 50 in the cover has more turns than the external threads on either the adapter or the liner collar. Therefore, the internal thread 50 of the cover 28 is simultaneously mountable over the first and second external threads 96, 80.

The liner collar 24 also has two series of external notches thereon 98 and 100 which are diametrically opposite from each other on the sleeve portion 90. The external notches 98 and 100 are engagedly mountable into the internal notches 82 when the liner collar 24 is installed in the adapter 26. The internal notches 82 in the adapter 26 are tapering in a counterclockwise direction when looking at the adapter 26 from the top. The external notches 98 and 100 are tapering in a clockwise direction. The respective diametrical spacings of the notches 82 and 100,98 are selected to provide an interference therebetween, when the liner collar 24 is mounted in the adapter 26.

Because of the tapering arrangement of the notches 82 and 98, 100, the interlocking engagement is obtained only when the liner collar 24 is urged in a counterclockwise direction relative to the adapter 26. In other words, the interlocking engagement is obtained when the cover 28 is being removed from the liner collar and the adapter assembly 24,26.

The preferred liner collar 24 is made of resilient plastic material and the interference mentioned above is smaller than an allowable deformation thereof. Therefore, when the liner collar 24 is rotated in a clockwise direction relative to the adapter 26, the external notches 98, 100 are allowed to slip over the internal notches 82. This feature is particularly advantageous for firstly installing a liner collar 24 inside a cover 28, and then for mounting the liner collar and cover assembly 24,28 to the adapter 26.

The liner collar 24 has two series of notches 98, 100 as opposed to a continuous series of notches. The reason for this being for reducing a friction generated between the notches and a corresponding effort required to install the liner collar and cover assembly 24,28 to the adapter 26. The plain segments 102 between the series of notches 98, 100 can be longer or shorter than the illustrated embodiment, depending upon the dimensions and the resilience of the material used in the manufacturing of the liner collar 24.

The overall diameter 'A' of the lip 92 in the liner collar 24 is an interference fit inside the diameter 'B' of the adapter 26, such that the installation of the liner collar 24 in the adapter 26 requires a slight effort by the user, and such that its proper placement in the adapter 26 is confirmable by a sudden reduction of this effort. For this purpose also, the height 'C' of the sleeve portion 90 on the liner collar 24 is greater than the height 'D' of the inner wall 78 of the adapter 26.

Figure 13:
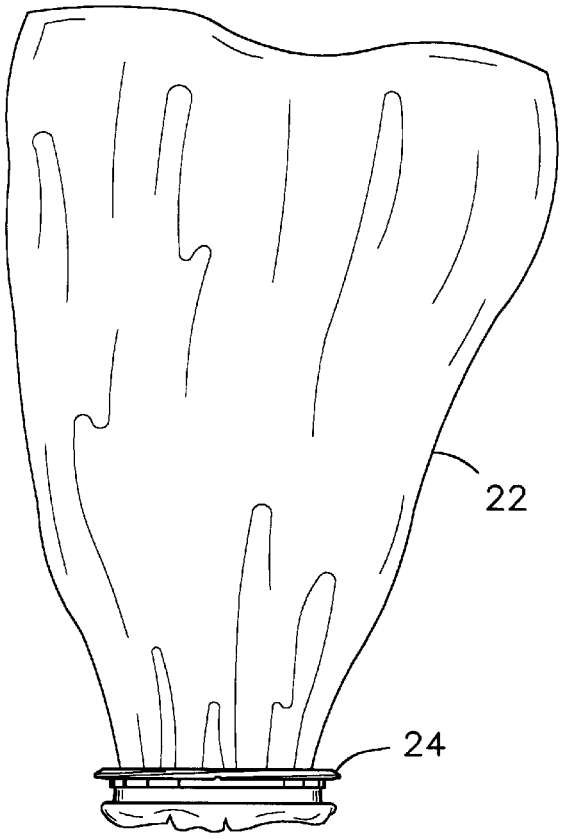
FIG. 13 is a side view of the liner and liner collar wherein the liner is shown as being turned inside-out for washing adhered product therefrom for example.

The interference fit mentioned above between the lip 92 and the inside diameter 'B' of the adapter 26, is also advantageous for retaining a liner 22 to a drum when the liner 22 is pulled inside-out for example as illustrated in FIG. 13, and as will be explained hereinbelow.

Figure 11:
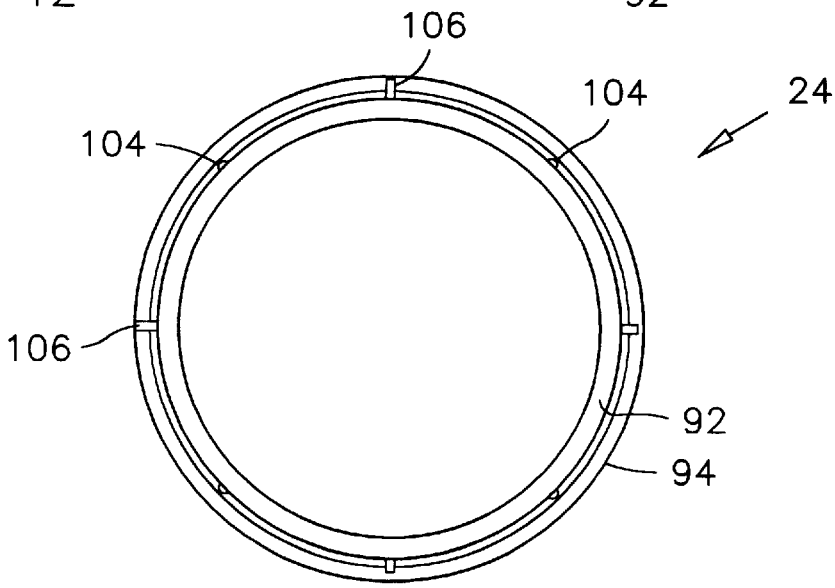
FIG. 11 is a bottom view of the liner collar shown in FIGS. 9 and 10.

The liner collar 24 also has a series of indentations 104 on the underside of the shoulder 94. These indentations 104 which are partly seen in FIG. 11, are useful for receiving a pair of pins on a manual tool (not shown) for installing the liner collar 24 in to the cover 28, when such tool is used.

The liner collar 24 also has several vent slots 106 for allowing air to escape from outside a liner 22 being deployed in a drum. When the liner collar 24 is installed in the cover 28, these vent slots 106 communicate through the thread 50 of the cover with one or more vent holes 108 through the cylindrical wall 110 of the cover 28, as may be understood by looking at the illustrations in FIGS. 3, 10, 11, 14 and 15.

Figure 12:
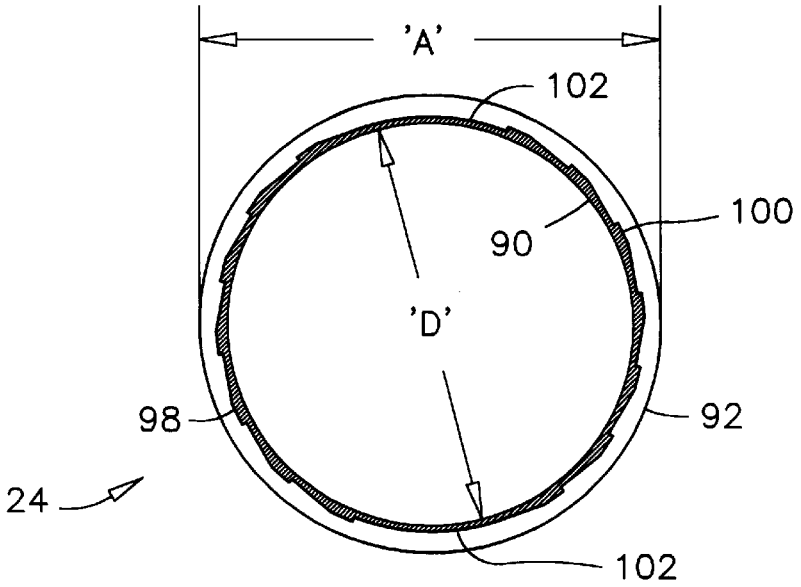
FIG. 12 is a cross-section view of the liner collar as seen along line 12—12 in FIG.10.

Referring now particularly to FIGS. 12 and 13, an important dimension of the liner collar 24 is a relatively large inside diameter 'D'. In the preferred embodiment, the inside diameter 'D' is at least about six to seven inches, but preferably about seven inches or more. This range of dimensions has been found to be appropriate for affording a relatively easy manipulation of the liner 22 during installation thereof in a drum, and for pulling this liner 22 inside-out of the liner collar 24 as illustrated in FIG. 13. The liner 22 and liner collar 24 can then be taken out of the drum and rinsed with hot water for example, for recovering maple syrup which had adhered to the inside surface thereof for example.

The large inside diameter 'D' also has the advantage of requiring an equally large inside diameter 'B' for the adapter 26. In the preferred embodiment, the diameter 'B' is at least about eight to nine inches or more, whereby a metal drum having the adapter 26 installed thereon is easily washed, sand-blasted and painted through the opening defined by the adapter 26. For example, a 32 imperial gallon drum can accommodate an adapter 26 having an inside diameter 'B' of up to about 13 inches or slightly more.

Figure 14:
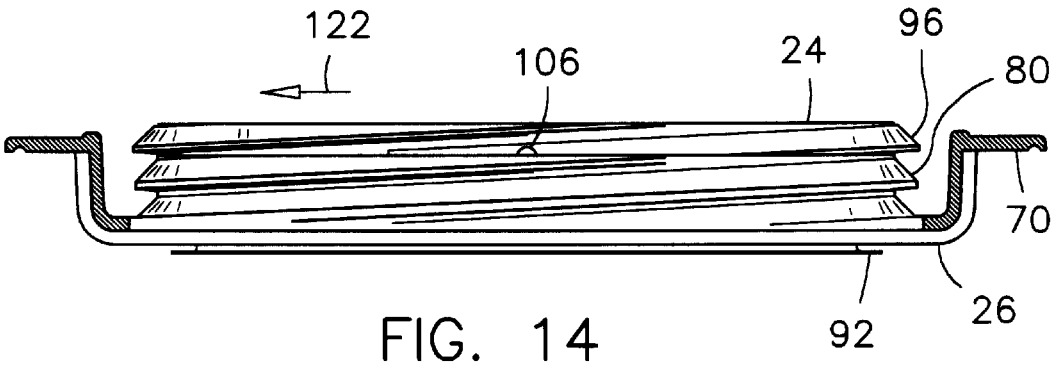
FIG. 14 is a partial cross-section view of the adapter with the liner collar mounted therein.
Figure 15:
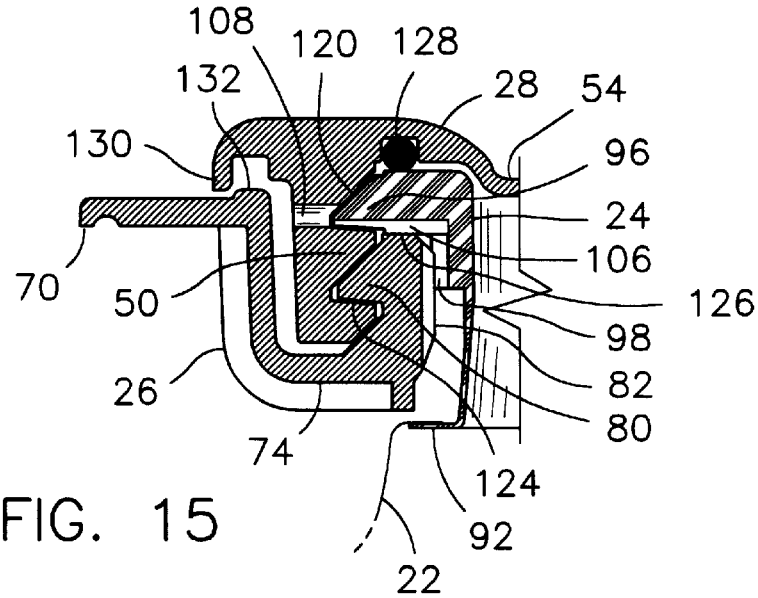
FIG. 15 is a partial cross section view of the drum liner system according to the preferred embodiment, taken across the rim of the adapter.

Referring now to FIGS. 14 and 15, the thread engagement of the drum liner support system according to the preferred embodiment and the corresponding advantages will be explained. As it was mentioned before, the first external thread 80 on the adapter 26, and the second external thread 96 on the liner collar 24 have a same shape and pitch. Therefore, when the liner collar 24 is mounted inside the adapter 26, the cover 28 may be continuously threaded over both external threads 96 and 80.

During the installation of the cover 28 over the adapter 26 and the liner collar 24, the collar 24 is able to slip over the adapter 26, because of the notches 82, 98 and 100, until the internal thread 50 in the cover 28 finds the start of the first external thread 80 in the adapter 26 and engages with this thread 80.

When the cover 28 is being installed over the adapter 26 and liner collar 24 assembly, and the second external thread 96 reaches the top 120 of the internal thread 50, a friction between the cover 28 and the liner collar 24 causes the liner collar 24 to move with the cover 28 to create a locknut effect. As can be understood, a slipping of the liner collar 24 in the clockwise direction as represented by arrow 122 in FIG. 14, causes the first and second threads 80, 96 to move away from each other vertically. This spreading of the threads 80 and 96 causes a pressure to occur at surfaces 120 and 124 on the internal thread 50 of the cover 28, and at the common bearing surface 126 between the liner collar 24 and the adapter 26.

This slight misalignment of the first and second external threads 96 and 80 causes the liner collar 24 to act as a locknut over the adapter 26 to prevent the cover 28 from loosening during transport and handling of a drum on which the liner system 20 is installed.

When the cover 28 is being rotated in the counterclockwise direction, the engagement of the notches 82,98, and 100 prevents the liner collar 24 from turning relative to the adapter 26, thereby allowing the removal of the cover 28. This feature is also appreciable for preventing the rotation and mangling of a deployed liner 22 when the cover 28 is being removed from the liner collar and adapter.

In regard to other features of the cover 28, an O-ring 128 is preferably provided therein for sealing the cover 28 over the liner collar 24. A circular lip 130 is also provided on the circumference of the cover 28 to engage over a circular shoulder 132 on the adapter 26. The overlapping of the lip 130 over the shoulder 132 prevents dust and other particles from entering the annular channel 74 of the adapter 26.

Figure 16:
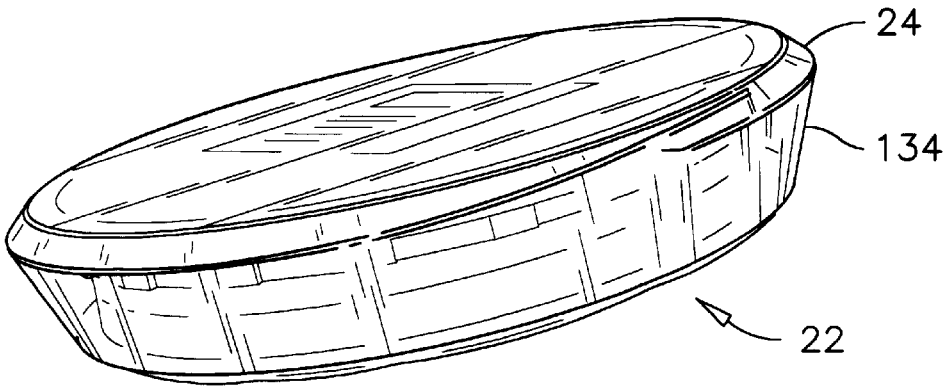
FIG. 16 is a perspective view of a wrapped liner and liner collar in a preferred packaging arrangement for shipment to a user.

In FIG. 16, there is illustrated a preferred package for shipping a clean liner 22 and liner collar 24 to a user. Because the inside diameter 'D' and the depth 'E' of a liner collar 24 are relatively large, the liner 22 is foldable inside the liner collar 24. For this purpose and other objectives mentioned herein before, the depth 'E' of the liner collar 24 is preferably about 2 inches.

A liner collar 24 and a liner 22 are preferably manufactured and sterilized under controlled conditions at the manufacturing plant, and shipped to a user in a wrapped and sealed condition in a plastic wrapper 134 for example. When the liner 22 is reused several times, it is preferably washed and sterilized under controlled conditions and similarly wrapped and sealed before shipment.

For those applications where extreme cleanliness is required, such as in the food industry for example, it is preferable to install a sterilized liner 22 and liner collar 24 inside a sterilized cover 28 having the O-ring 128, for sealing the liner collar 24 to the cover 28, before wrapping and sealing this assembly. A storing, delivery and installation of the liner 22 can thereby be effected without ever exposing the interior of the liner 22 to ambient air. In these applications, it will be appreciated that one of the openings 56,58 in the cover 28 may be used for applying a vacuum to this assembly during packaging.

Figure 17:
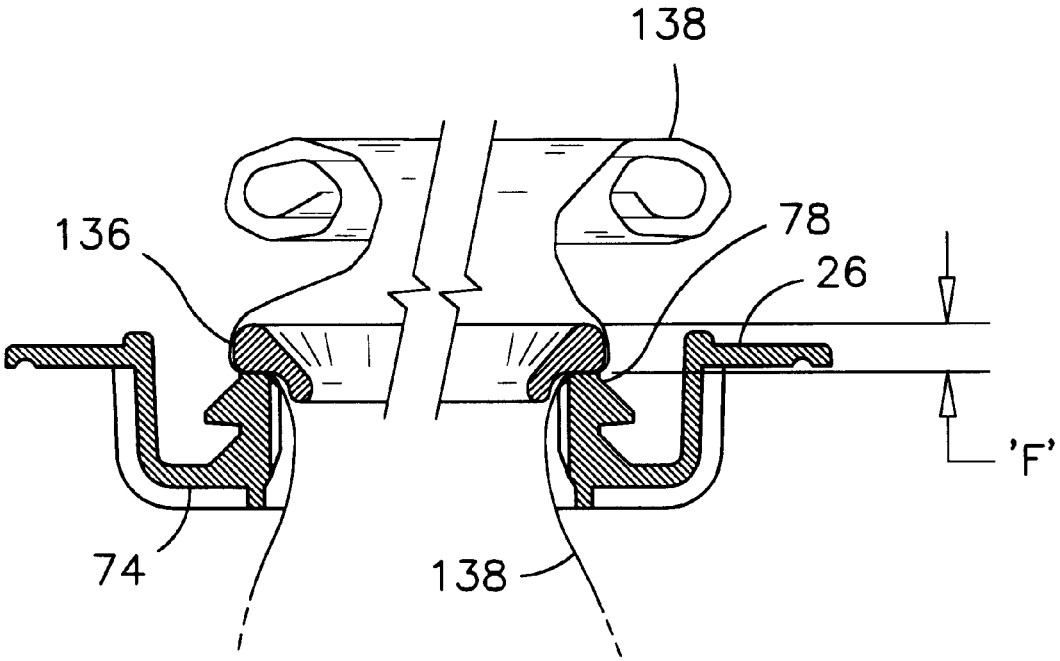
FIG. 17 is a partial cross-section view of the adapter, in an alternate use for retaining a collar-less liner, taken across the rim of the adapter.
Figure 18:
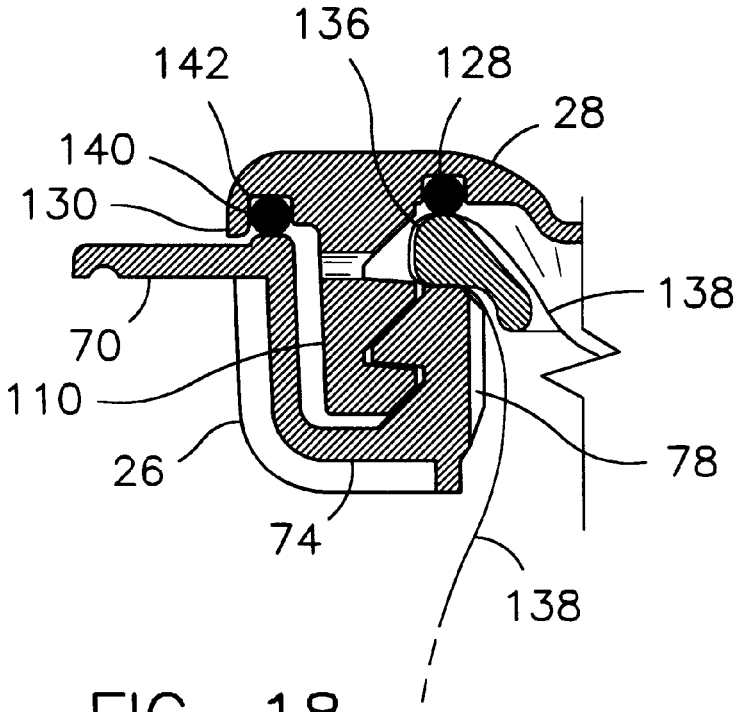
FIG. 18 is an enlarged partial cross-section view of the adapter and the cover in the alternate use for retaining a collar-less liner, taken across the rim of the adapter.

An alternate use of the adapter 26 and cover 28 is illustrated in FIGS. 17 and 18. In this particular application, a ring 136 which has substantially a similar outside diameter as the inside wall 78 of the adapter 26, is placed inside a collar-less liner 138 and over the inside wall 78 of the adapter 26. Upon filling, the collar-less liner 138 is allowed to slip between the ring 136 and the inside wall 78 and to expand inside a drum. This application is particularly appreciable for allowing a liner 138 to expand against all inside surfaces of a drum during filling, to avoid the creation of air pocket between the drum and the liner 138.

When the drum is full, the neck of the liner 138 is folded inside the ring 136 and the cover 28 is installed over the adapter 26 to cover the ring 136 and the liner 138. The ring has a thickness 'F' which is substantially the same as the thickness of the upper annular shoulder 94 on the liner collar 24, such that the cover 28 is still mountable over the adapter 26. In this installation, however, an additional O-ring 140 is preferably installed inside a groove 142 defined by the lip 130 and the cylindrical wall 110 of the cover 28, between the cover 28 and the circular shoulder 132 of the adapter 26, to prevent contaminant from entering the circular channel 74 of the adapter 26 and for preventing contaminant from entering the liner 138. It will also be appreciated that this double O-ring arrangement 128, 140, can also be used with the liner collar 24, as explained hereinbefore.

As to additional details related to the manufacturing, installation and use of the drum liner system 20 of the present invention, the same should be apparent from the above description, and accordingly further discussion relative to the manner of making and using this system would be considered redundant and is not provided.

While one embodiment of the present invention has been described herein above, it will be appreciated by those skilled in the art that various modifications, alternate structures, alternate mounting arrangements and equivalents may be employed without departing from the true spirit and scope of this invention. Although the advantages of the drum liner system of the present invention has been described for use in storing and transporting maple syrup, it will be appreciated by those skilled in the art that similar advantages are obtained in the production and commerce of molasses, jams, sauces, beverage concentrates, water and even in the transport of granular fertilizer products for examples. Therefore, the above description and illustrations should not be construed as limiting the scope of the invention which is defined by the appended claims.

I claim:

1. In combination, a drum and a drum liner system installed therein, said drum having a designated top and bottom surfaces and an opening in said designated bottom surface, said designated top surface having a bung hole therein, said drum being usable in an upside down position; said drum liner system comprising:

an adapter mounted in said opening, and a drum liner affixed to said adapter and being deployed inside said drum;

such that said opening and said adapter have a relatively large size through which said drum is easily repairable and said drum liner is easily mountable for storing and transporting sensitive products.

2. The combination as claimed in claim 1 wherein said adapter has an inside diameter of about 8 to 9 inches.

3. The combination as claimed in claim 2, further comprising a liner collar mounted over said adapter and having a sleeve extending inside said inside diameter of said adapter and being bonded to said liner.

4. The combination as claimed in claim 3, further comprising a cover mounted over said liner collar and said adapter for covering said inside diameter of said adapter and said liner collar.

5. The combination as claimed in claim 4, wherein said liner collar has a first series of vent holes therein and said cover has a second series of vent holes therein, and said first series of vent holes being in communication with said second series of vent holes.

6. The combination as claimed in claim 4, wherein said adapter has a first external thread, said liner collar has a second external thread having common shape and pitch with said first external thread on said adapter and being continuous with said first external thread on said adapter, and said cover has an internal thread which is engaged over said first and second external threads for retaining said liner collar to said adapter and to said cover.

7. The combination as claimed in claim 6, wherein said adapter and said liner collar have respective interlocking notches for preventing a rotation of said liner collar relative to said adapter when said internal thread is being disengaged from said first and second external threads.

8. The combination as claimed in claim 6, wherein said cover has a pair of spaced-apart parallel ribs thereon for easing an engagement of said internal thread over said first and second external threads.

9. The combination as claimed in claim 2, wherein said adapter has a flange with holes therein for attachment to said designated bottom surface of said drum with fasteners.

10. A drum liner system for installation in a drum for transporting a sensitive product, said drum liner system comprising:

an adapter mountable in an opening in an end of a drum and having an annular flange and an annular channel member bordering said annular flange and extending through a plane defined by said annular flange; said annular channel having a first external thread therein;

a liner collar mounted over said adapter and having a sleeve extending inside said annular channel; said liner collar having a second external thread thereon, and said second external thread being similar to and continuous with said first external thread;

a drum liner bonded to said sleeve; and a cover covering said liner collar and having an internal thread therein having a similar shape and pitch as said first and second external threads and being engaged over said first and second threads;

such that said liner collar and said adapter are retainable to each other and to said cover, and are selectively relatively positional for wedging said first and second external threads against each other and inside said internal thread for securing said cover over said adapter and said liner collar.

11. The drum liner system as claimed in claim 10, wherein said adapter and said cover have relative sliding fit tolerances therebetween.

12. The drum liner system as claimed in claim 11, wherein said sleeve has external taper notches thereon and said annular channel has internal taper notches thereon which are engaged in interference with said external taper notches.

13. The drum liner system as claimed in claim 12, wherein said external taper notches and said internal taper notches are oppositely oriented to interfere with each other to prevent relative displacement thereof in a first direction.

14. The drum liner system as claimed in claim 13, wherein said liner collar is made with a resilient material and said sleeve is radially deformable for allowing a rotation thereof relative to said adapter and said internal and external taper notches, in a second direction opposite said first direction.

15. A drum liner package for installation in a drum having a drum liner adapter mounted therein, said drum liner package comprising:

a liner collar having an inside diameter and a depth perpendicular to said inside diameter;

a drum liner bonded to said liner collar and folded inside said inside diameter and said depth, and a hermetic wrapper stretched around said liner collar and said drum liner;

such that said drum liner package is shippable to a user in an aseptic condition.

16. The drum liner package as claimed in claim 15, further comprising a cover partly enclosing said liner collar and wherein said hermetic wrapper is stretched around said cover, said liner collar and said liner.

17. The drum liner package as claimed in claim 15, wherein said inside diameter is about six to seven inches and said depth is about two inches.

18. The drum liner package as claimed in claim 16, wherein said cover has an internal thread therein, said liner collar has an external thread thereon and said external thread is engaged with said internal thread for retaining said liner collar to said cover.

19. The drum liner package as claimed in claim 18, further comprising an O-ring mounted between said cover and said liner collar for sealing said liner collar to said cover.

20. The drum liner package as claimed in claim 18, wherein said internal thread in said cover has more turns than said external thread on said liner collar.

* * * * *